United States Patent [19]

Miller

[11] Patent Number: 4,768,309

[45] Date of Patent: Sep. 6, 1988

[54] K-LAND GRINDER

[75] Inventor: Joseph L. Miller, Rochester, Mich.

[73] Assignee: Joseph L. Miller, Rochester, Mich.

[21] Appl. No.: 75,141

[22] Filed: Jul. 20, 1987

[51] Int. Cl.[4] ..... B24B 7/00

[52] U.S. Cl. ..... 51/128; 51/285

[58] Field of Search ..... 51/128, 102, 285, 109 BS, 51/230 R, 109 R

[56] References Cited

U.S. PATENT DOCUMENTS 1,013,760 1/1912 Gardner ..... 51/128

2,248,953 7/1941 Bunch ..... 51/128

*Primary Examiner*—Frederick R. Schmidt

*Assistant Examiner*—Lawrence Cruz

*Attorney, Agent, or Firm*—Lyman R. Lyon

[57] ABSTRACT

An abrading apparatus for forming a chamfer of precise dimension along the cutting edge of a cutting tool, having a tool guide with first and second perpendicularly intersecting supporting surfaces with a slot formed in the tool guide to accommodate the protrusion of a portion of a grinding wheel having an annular abrading surface. The tool guide can be pivotally adjusted about an axis collinear with a diameter of the grinding wheel that lies in the plane of the abrading surface and positioned within the plane of the first supporting surface.

5 Claims, 3 Drawing Sheets

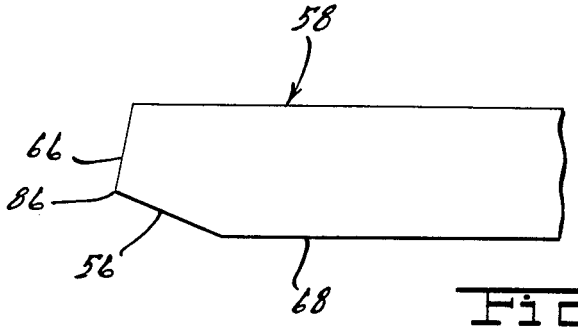
Fig. 5.
Fig. 6.
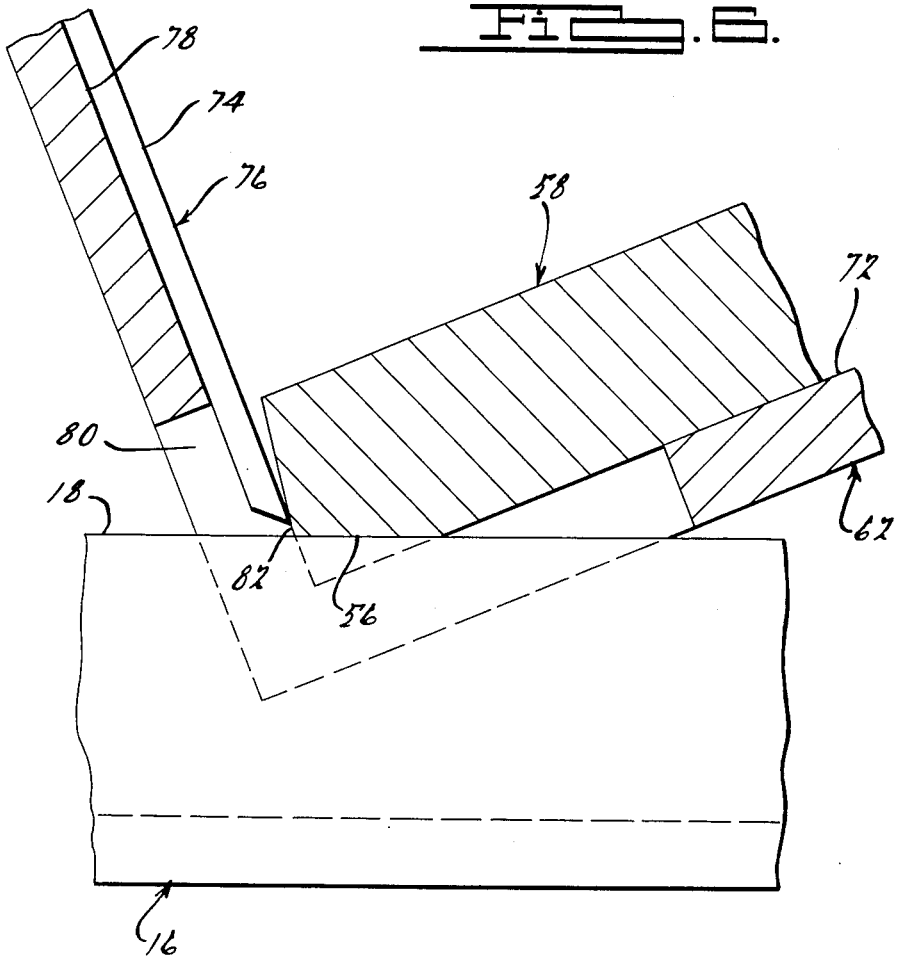

K-LAND GRINDER

BACKGROUND OF THE INVENTION

The instant invention relates to an apparatus for preparing the cutting edge of a cutting tool, such as a sintered ceramic insert, by forming a chamfer of precise dimension and orientation thereon.

It is frequently desirable to provide a chamfer along the cutting edge of a cutting tool in order to reduce stress concentration encountered during use, thereby preventing edge chipping and increasing tool life. The chamfer, or K-land, is defined by the angle it makes with the leading face of the cutting tool, and its width, i.e., the distance in the plane of the tool's leading face from the beginning of the chamfered portion thereon to the edge generated by the intersection of the chamfered portion and the end face of the tool.

The prior art teaches the forming of the chamfered edge by way of an intuitive process wherein the edge of a sample tool is slightly abraded on a grinding machine having tool guides that are preliminarily set by, perhaps, a garden-variety protractor. The resulting chamfer is checked with the aid of an optical comparator. The tool guides are repeatedly readjusted and the tool edge abraded until such time as satisfactory chamfer dimensions are obtained. There is no means for determining the width of the chamfer other than measuring the chamfer subsequent to an abrading operation. The resultant trial-and-error procedure is very imprecise, and chamfer results are not reproducible with any degree of precision. Still greater difficulty is encountered when trying to form compound chamfers on the cutting-tool edge. Moreover, it is inherently problematical to use trial and error to obtain a chamfer width where the reference point from which the width is to be measured is itself being abraded, as is the case where the cutting tool is provided with a non-zero end-relief angle.

The intuitive nature of such a prior art process produces an involved, labor-intensive, and yet quite imprecise, method of apparatus set-up, thereby lowering process flexibility while making low volume batch processing uneconomical. Precisely prepared cutting-tool edges can not be predictably obtained with prior art methods. Automation is not a practical alternative, as industry demand is typified by low quantity orders for custom chamfered tool bits.

It is to be noted that the abrading machine characteristically employed by prior art edge preparation methods comprises a grinding wheel whose abrading surface travels in the direction parallel to the cutting edge of the tool. While the parallel orientation of abrading surface travel and cutting-tool edge is reasonably well suited for the edge preparation of sintered carbide tool bits, the use of a perpendicular direction of abrading surface travel appears to be advantageous for chamfering ceramic cutting-tool inserts. Moreover, the parallel orientation of abrading surface travel and cutting-tool edge further complicates the generation of an accurate chamfer around the corners (nose radii) of the tool—particularly of inserts having small inscribed circle dimensions—since the locating surface available for supporting the tool during edge preparation is reduced due to the larger aperture required therein to permit protuberance of the machine's arcuate abrading surface.

SUMMARY OF THE INVENTION

The K-land grinder of the instant invention comprises a cup-shaped grinding wheel and an adjustable L-shaped tool guide whereupon a cutting tool is accurately positioned relative to the abrading surface of the grinding wheel. More specifically, the tool guide comprises first and second perpendicularly intersecting planar supporting surfaces having a slot formed so as to extend laterally from the line of intersection therebetween into each supporting surface. The tool guide slot permits the protrusion therethrough of a portion of the annular abrading surface of the grinding wheel, with the line of intersection of the supporting surfaces lying perpendicular to the direction of abrading surface travel of the grinding wheel. The tool guide pivots about a diameter of the grinding wheel that is coplanar with the abrading surface of the grinding wheel, with the first supporting surface remaining coplanar with the pivotal axis. Moreover, the tool guide is positionable within the plane of the first supporting surface so as to preselect the distance from the second supporting surface to the pivotal axis.

The chamfer angle, i.e., the angle defined by the intersection of the plane of the first supporting surface with the plane of the abrading surface of the grinding wheel, is thus readily selected by pivoting and then securing the tool guide relative to the abrading surface of the grinding wheel. The width of the chamfer formed on the cutting edge of a cutting tool is preselected by adjusting of the distance between the second supporting surface and the pivotal axis of the tool guide within the plane of the first supporting surface. The direction of travel of the abrading surface of the grinding wheel is perpendicular to the edge of the tool, and the narrow slot in the tool guide through which the abrading surface of the grinding wheel protrudes minimizes the reduction of supporting surface area available for contacting the workpiece, thereby maximizing workpiece control. An alternate embodiment of the instant invention allows for the preselection of chamfer angle and chamfer depth, i.e., the distance from the beginning of the chamfered portion on the end face of the tool to the plane of the leading face thereof. The preselection of chamfer depth is particularly useful in the formation of compound chamfers on tools having non-zero end-relief angles, as the reference point remains unchanged throughout the abrading process.

BRIEF DESCRIPTION OF THE DRAWINGS

FIG. 5 is a fractionated side view of a cutting tool insert having a chamfered cutting edge and a non-zero end-relief angle; and FIG. 6 is a view similar to that of FIG. 4 of the tool guide of the alternate embodiment whereupon an insert having a non-zero end-relief angle is situated.

DETAILED DESCRIPTION OF THE PREFERRED EMBODIMENT OF THE INVENTION

Figure 1:
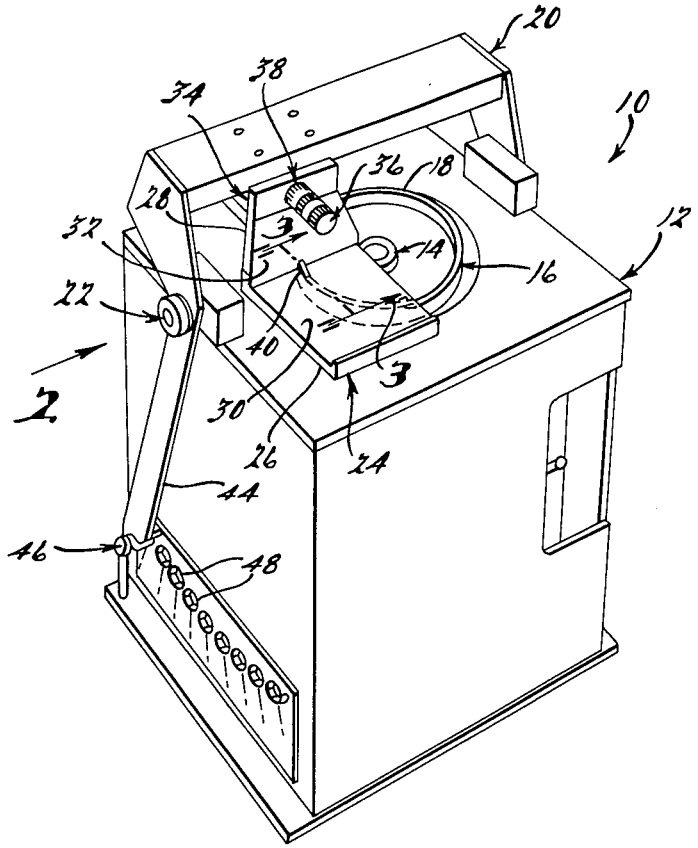
FIG. 1 is a view in perspective of the K-land grinder constructed in accordance with the instant invention.
Figure 2:
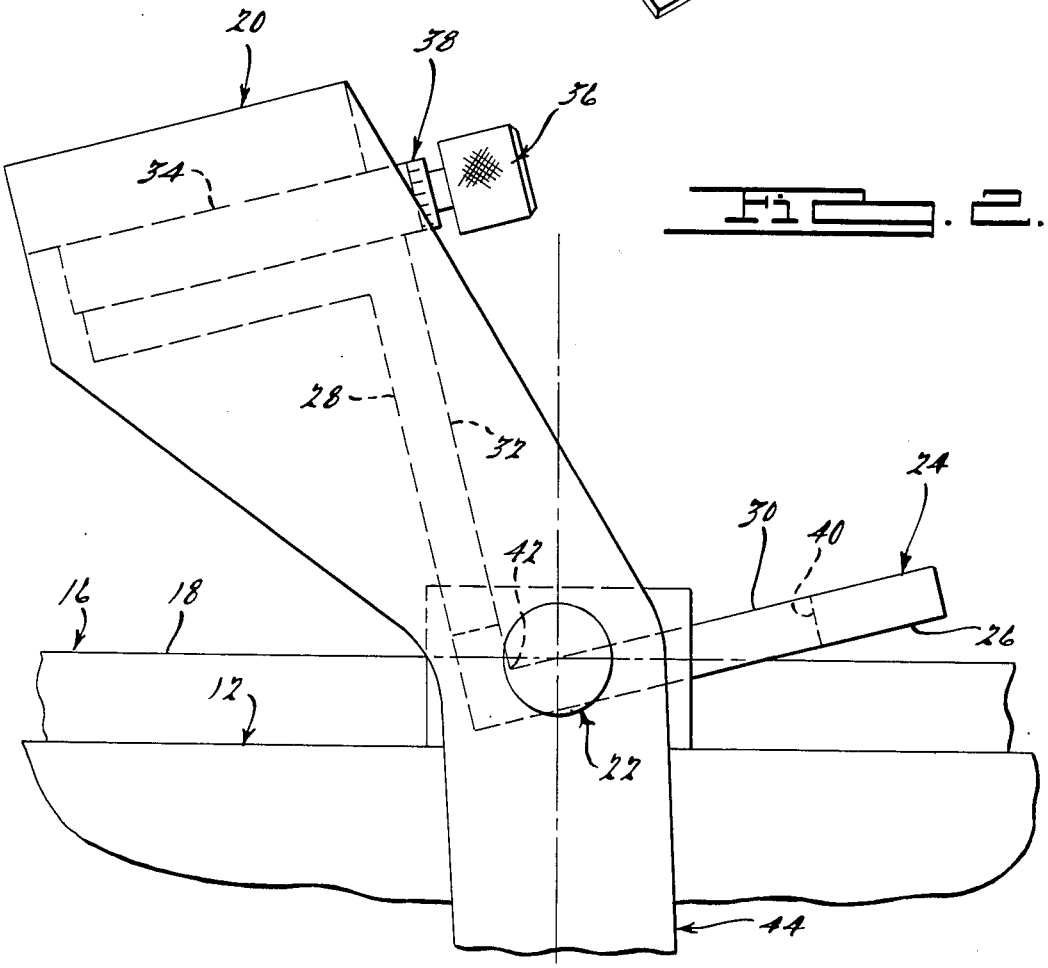
FIG. 2 is a side view in elevation of the pivoting bracket and tool guide of the K-land grinder in the direction of the arrow 2 in FIG. 1.

As illustrated in FIG. 1, a K-land grinding apparatus 10 constructed in accordance with the instant invention comprises a housing 12 which encloses an electric motor (not shown) having a vertically oriented spindle 14 upon which rotates a cup-shaped grinding wheel 16, i.e., a grinding wheel 16 having an annular abrading surface 18 in the plane normal to the rotational exis thereof. A bracket 20 is pivotally mounted on the housing 12 upon a pair of trunnions 22 whose centerlines are aligned with a diameter of the grinding wheel 16 lying within the plane of the abrading surface 18 thereof. An L-shaped tool guide 24, comprised of leg portions 26 and 28 which define a first and second perpendicularly intersecting planar workpiece-supporting surface 30 and 32, respectively, is attached to the pivoting bracket 20 via an adjustable coupling 34 so that the first supporting surface 30 is maintained in coplanar relationship with the pivotal axis of the bracket 20, as shown in FIG. 2. The coupling 34 positions the tool guide 24 within the plane of the first supporting surface 30 in the direction normal to the line of intersection between the supporting surfaces 30 and 32 by rotating thumbscrew 36, with a vernier 38 indicating the resultant displacement of the second supporting surface 32 from the pivotal axis of the bracket 20. The tool guide 24 is provided with a narrow slot 40 formed laterally in the crotch 42 thereof so as to be tangential to the abrading surface 18 of the grinding wheel 16. The slot 40 accommodates the protuberance of a portion of the abrading surface 18 of the grinding wheel 16 through the tool guide 24 to the extent dictated by the displacement of the second supporting surface 32 from the pivotal axis of the bracket 20. Thus, the width of the chamfer generated on the edge of the cutting tool by the apparatus of the instant invention 10 is determined by adjustment of the thumbscrew 36.

As shown in FIG. 1, the bracket 20 is provided with a lever portion 44 extending perpendicularly from its pivotal axis having a locating pin, such as a spring-loaded tapered plunger 46, located in the free end thereof. The bracket 20 and, hence, the tool guide 24 attached thereto, is angularly adjusted relative to the housing 12 and, hence, the plane of the abrading surface 18 of the grinding wheel 16, by engaging the plunger 46 with one of several bushings 48 precisely machined in the housing 12, whereby the desired chamfer angle is prescribed and maintained.

Safety guards (not shown) may be added to prevent accidental contact with the grinding wheel 16 and to prevent damage or injury due to flying sparks generated during the abrading operation. A wheel dresser (not shown) can be added to facilitate fine vertical positioning of the grinding wheel 16.

Figure 3:
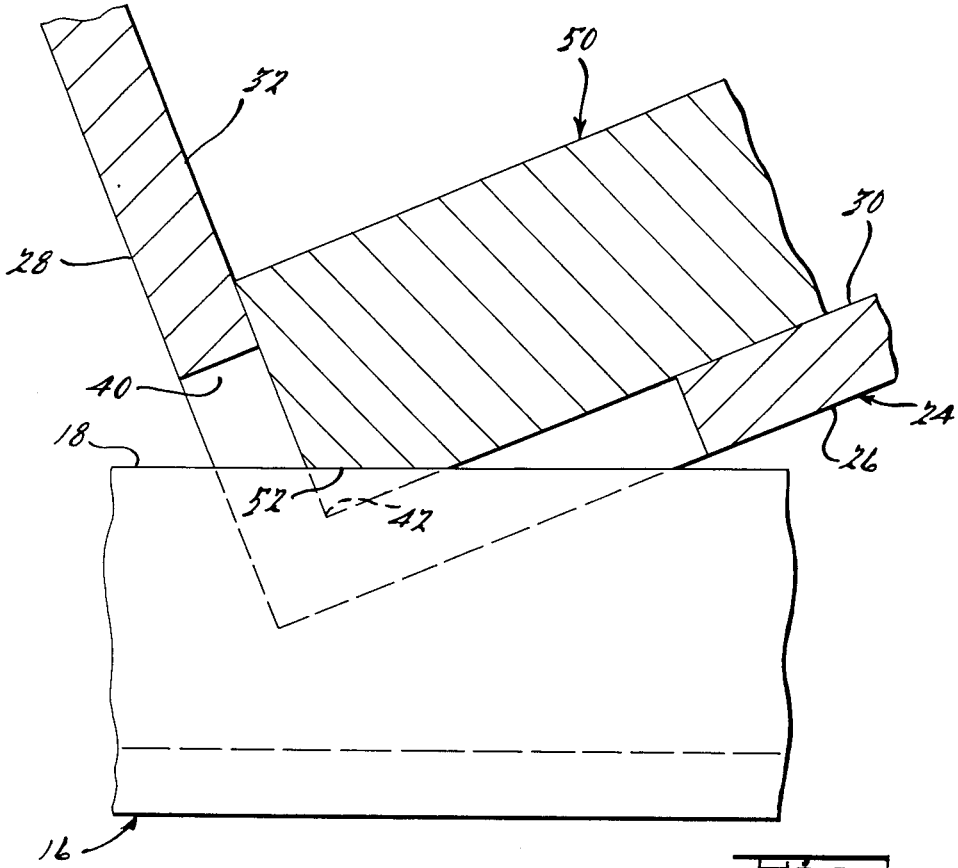
FIG. 3 in an enlarged view in cross-section of the tool guide of the K-land grinder along line 3—3 of FIG. 1 having a cutting tool insert located thereupon.

In operation, with the grinding wheel 16 dressed and, thus, with the abrading surface 18 thereof properly positioned in coplanar relationship with the pivotal axis of the bracket 20, the lever portion 44 of the bracket 20 is adjusted so as to engage the tapered plunger 46 therein with the bushing 48 corresponding to the desired chamfer angle. The thumbscrew 36 is rotated so as to set the desired chamfer width as indicated on the vernier 38, and the motor is started. The apparatus 10 is thus set to generate a chamfer of precise dimension on the edge(s) of one or more cutting tools. FIG. 3 shows a cutting tool 50 placed in contiguity with the supporting surfaces 30 and 32 of the tool guide 24. The cutting tool 50 is slid along the crotch 42 of the tool guide 24 and over the slot 40 formed therein, whereby the tool 50 makes precise contact with the abrading surface 18 of the grinding wheel 16 traveling perpendicular thereto. A chamfer 52 of precise dimension is thus formed on the edge of the tool 50. The narrow slot 40 in the tool guide 24 required to accommodate the protrusion therethrough of the abrading surface 18 of the grinding wheel 16 minimizes the reduction in area of the supporting surfaces 30 and 32, thereby affording greater control over the positioning of the cutting tool 50 during the edge preparation thereof.

Figure 4:
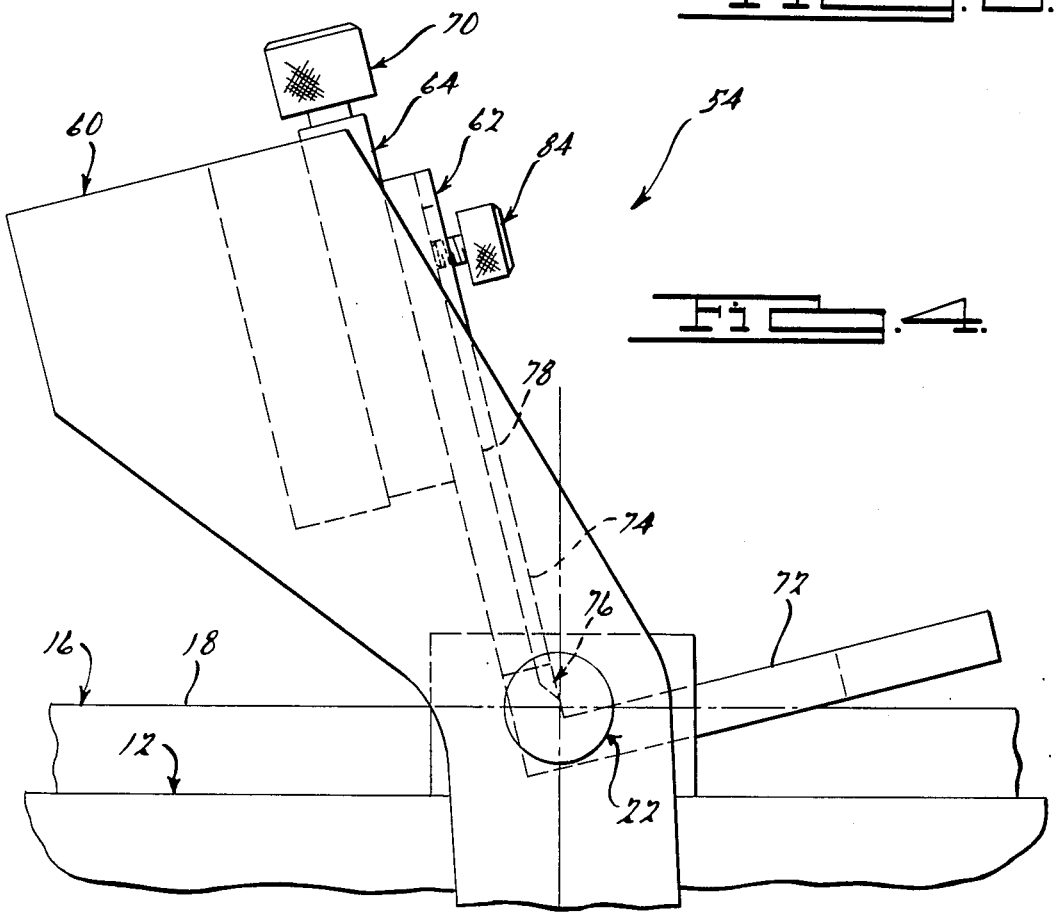
FIG. 4 is a view similar to that of FIG. 2 of an alternate embodiment of the K-land grinder of the instant invention.

Referring to FIGS. 4–6, an alternate embodiment 54 of the apparatus of the instant invention for forming a chamfer 56 on a cutting tool 58 having a non-zero end-relief angle comprises a pivoting bracket 60 which supports an L-shaped tool guide 62 via an adjustable coupling 64 so as to allow preselection of the depth of the chamfer 62, i.e., the dimension along the end face 66 of the tool 58 perpendicular to the leading face 68 thereof as shown in FIG. 5, rather than the width thereof. Rotation of the thumbscrew 70 adjusts the depth of the chamfer 56 to be generated relative to the cutting tool's leading face 68 by displacing the "second" tool guide supporting surface 72 from the bracket's pivotal axis while the "first" tool guide supporting surface 74 is maintained in coplanar relationship with the pivoting axis of the bracket 60.

A supporting surface extension plate 76, slidably mounted within a groove 78 formed in supporting surface 74, extends supporting surface 74 across the portion of the slot 80 therein not utilized for grinding wheel protrusion. In operation, the end 82 of the extension plate 78 is adjusted and thereafter maintained in close-spaced juxtaposition with the abrading surface 18 of the grinding wheel 16 by suitable locking means, such as frictional engagement between a threaded element 84 manually advanced through a threaded bore therein and the basal surface of the groove 80. The enhanced area of contact between the cutting tool 58 and supporting surface 74 resulting from the use of extension plate 78 aids in the formation of a chamfer 56 about a corner, or nose radius, of the cutting tool 58, particularly when the cutting tool 58 comprises an insert having small depth and inscribed circle dimensions.

As may be readily appreciated upon reference to FIG. 5, the use of the leading face 68 of the tool 58 as a reference surface, as opposed to the end face 66 thereof, is particularly desirable where the tool 58 is provided with a non-zero end-relief angle: as the chamfer 56 is generated, the position of the tool "end" 86 changes, thereby making measurement of chamfer width more dificult. The difficulty is compounded when a double or triple chamfer is to be formed on the tool edge. In contradistinction, the existence of an end-relief angle does not affect the chamfer depth dimension, as it is measured from an unchanging reference, the cutting-tool leading face 68.

While the preferred embodiment of the invention has been disclosed, it should be appreciated that the invention is susceptible of modification without departing from the spirit of the invention or the scope of the subjoined claims.

I claim:

1. An apparatus for preparing the cutting edge of a sintered cutting tool comprising a grinding wheel having an annular abrading surface in the plane normal to the rotational axis thereof;

a tool guide having first and second perpendicularly intersecting planar supporting surfaces and a slot formed therein extending laterally from the intersection of the supporting surfaces to accommodate protrusion therethrough of a portion of the abrading surface of said grinding wheel;

means for pivoting said tool guide about an axis collinear with a diameter of said grinding wheel that lies within the plane of the abrading surface of said grinding wheel;

means for prescribing and maintaining the angle defined by the intersection of the plane of the abrading surface of said grinding wheel with the plane of the first supporting surface of said tool guide;

means for positioning said tool guide within the plane of the first supporting surface along the line perpendicular to the second supporting surface while maintaining the first supporting surface of said tool guide in coplanar relationship with the pivoting axis of said tool guide; and means for prescribing and maintaining a distance between the plane of the second supporting surface and pivoting axis of said tool guide.

2. An apparatus for preparing the cutting edge of a sintered cutting tool comprising an electric motor having a rotary output shaft;

a grinding wheel mounted on the shaft of said motor having an annular abrading surface in the plane normal to the rotational axis thereof;

a housing encompassing said motor having an aperture allowing the protuberance therefrom of said grinding wheel;

a tool guide having first and second perpendicularly intersecting planar supporting surfaces and a slot formed therein extending laterally from the intersection of the supporting surfaces to accommodate protrusion therethrough of a portion of the abrading surface of said grinding wheel;

a bracket pivotally mounted on said housing for supporting said tool guide, whereby said tool guide is pivoted about a diameter of said grinding wheel that is coplanar with the abrading surface thereof while the first supporting surface of said tool guide is maintained in coplanar relationship with the pivotal axis;

means for securing said bracket relative to said housing, whereby the angle generated by the intersection of the plane of the abrading surface of said grinding wheel with the plane of the first supporting surface of said tool guide is prescribed and maintained; and adjustable means on said bracket for positioning said tool guide relative thereto within a plane parallel with that of the first supporting surface in the direction that is normal to the seond supporting surface, whereby the distance between the plane of the second supporting surface and pivoting axis of the tool guide is prescribed and maintained.

3. The apparatus of claim 2 wherein the means on said bracket or securing said bracket relative to said housing comprises a lever portion of said bracket extending outwardly from the pivotal axis thereof and having a locating pin attached thereto, said locating pin to mate with a plurality of bushings formed in said housing so as to position and secure the bracket at a prescribed angle relative to said housing.

4. The apparatus of claim 2 wherein the adjustable means on said bracket for positioning said tool guide relative thereto comprises a coupling permitting linear displacement thereof within the plane thereof as determined by rotation of a threaded element.

5. The apparatus of claim 4 including a vernier, whereby linear displacement of said tool guide relative to said bracket is measured.

* * * * *